United States Patent [19]

Colbert

[11] Patent Number: 4,657,204

[45] Date of Patent: Apr. 14, 1987

[54] WELDING WIRE DISPENSER

[76] Inventor: Robert E. Colbert, 3843 E. Walmont, Jackson, Mich. 49203

[21] Appl. No.: 829,625

[22] Filed: Feb. 14, 1986

[51] Int. Cl.[4] ..... B65H 49/00

[52] U.S. Cl. ..... 242/128

[58] Field of Search ..... 242/128, 129.5, 129.7, 242/129.71, 129.72, 129.8, 156, 156.1, 54 R

[56] References Cited

U.S. PATENT DOCUMENTS

| | | | |
|---|---|---|---|
| 1,159,815 | 11/1915 | Walsh | 242/128 |
| 1,834,159 | 12/1931 | King, Jr. et al. | 242/128 |
| 2,319,828 | 5/1943 | Rohweder | 242/128 |
| 2,880,305 | 3/1959 | Baird | 242/128 X |
| 3,618,873 | 11/1971 | Fons et al. | 242/128 |
| 4,253,624 | 3/1981 | Colbert | 242/128 |

FOREIGN PATENT DOCUMENTS

| | | | |
|---|---|---|---|
| 2721616 | 11/1978 | Fed. Rep. of Germany | 242/128 |

*Primary Examiner*—Stanley N. Gilreath

*Attorney, Agent, or Firm*—Beaman & Beaman

[57] ABSTRACT

A dispenser for removing coiled wire or strands from a stationary coil having a vertical axis particularly suited for, but not limited to, use with welding wire. The wire is removed from the coil periphery by a wire guide rotatable about an axis coincident with the coil axis. The improvements include a dust cover enclosing the wire coil which rotates with and under the influence of the wire guide. Further, a base is used with unspooled wire having a quick coupling connection with the wire guide support, a coil compression ring is shaped to impose a biasing force on the coiled wire as the coil is depleted to improve wire retention, and a quick disconnect coupling is interposed between the rotating guide and a wire receiving conduit to improve handling and coil replacement procedures. Improvements are also directed to the use of the dust cover with spooled wire, and a synthetic plastic coil base is disclosed for protecting the wire coil's lower regions.

18 Claims, 17 Drawing Figures

WELDING WIRE DISPENSER

BACKGROUND OF THE INVENTION

Wire and elongated strands are usually shipped and handled in coil form, and wire may be dispensed from the coil by rotating the coil about its axis, or the wire may be uncoiled over the end of a stationary coil. Coils of welding wire may weigh one thousand pounds or more and because of the coil weight, it is impractical to rotate the coil as the wire is dispensed for welding purposes. Accordingly, welding wire dispensers have been developed wherein the wire is peripherally removed from a stationary coil by a rotating guide as shown in my U.S. Pat. No. 4,253,624.

Various problems exist with known wire dispensers which have not been successfully overcome. For instance, wire and strand dispensers are often used in an environment laden with dust and small airborne particles of foreign matter, liquids and gases, and as a large coil of welding wire may take several months to deplete, the coiled wire is subject to corrosion and contamination which may adversely affect the welding characteristics and the resultant welds. However, because of the construction of known welding wire dispensers, practical and effective protection of the welding wire from the environment has not been achieved.

Further, welding wire dispensers of the rotating guide type have used a guide support threaded into a base upon which the coil rests. The rough handling to which such guide supports are subjected often damages the threads of the guide support and base rendering assembly of these components difficult and haphazard.

Another problem which exists with prior art dispensers of this type lies in the adverse dispensing characteristics that occur as the coil is depleted. With unspooled coils it is common place to compress the coils with a compression ring such as shown in U.S. Pat. No. 4,253,624 and the compression ring radially extends over the upper regions of the coil. As the coiled wire is depleted, the compression ring must be retightened in order to control the confinement of the wire and the operators often forget to continually retighten the compression ring. Automatic means for maintaining the compression of the ring on the coil is needed.

As depleted coils are replaced, it is necessary that the conduit which receives the coiled wire from the coil and transports the wire to the welder must be disconnected, and the available structure interconnecting the wire guide and wire conduit is presently of such nature as to be inconvenient to connect and disconnect.

Further, improvements are needed in the protection of the lower region of the coils of unspooled wire, and inexpensive apparatus for providing such protection is presently not available.

It is an object of the invention to provide a welding wire dispenser for either spooled or unspooled wire coils wherein the wire is closely confined within a dust cover and protected from the environment.

Another object of the invention is to provide a welding wire dispenser having a dust cover associated therewith wherein the dust cover rotates with the rotating wire guide and such rotation is produced by the guide and the guide does not require additional drive apparatus.

Yet a further object of the invention is to provide a welding wire dispenser having a dust cover wherein the dust cover includes a cover extending over the coil upper end and a transparent curtain vertically extending along the coil periphery.

An additional object of the invention is to provide a compression ring for compressing unspooled coiled wire, the compression ring having a deformable resilient configuration which will automatically conform to the coiled wire during depletion and minimize the necessity for retightening the coil compression ring.

Another object of the invention is to provide a welding wire dispenser having a base supporting a vertically extending wire guide support wherein a quick release connection between the base and support is provided which is relatively foolproof in operation, capable of positively locking the support relative to the base against axial displacement, and which is not readily damaged by careless handling.

A further object of the invention is to provide a welding wire dispenser having a quick release coupling of the rotatable type interposed between a wire guide outlet and a wire conduit wherein these components may be readily assembled and disassembled, and are capable of relative rotation.

An additional object of the invention is to provide a welding wire dispenser for spooled wire wherein a dust cover may be employed therewith and the dust cover rotates relative to the spool.

Yet another object of the invention is to provide a base for coiled unspooled wire which is impervious to moisture and which is readily oriented to the coil and capable of supporting a rotating wire dispensing guide.

In the practice of the invention a coil of welding wire, either spooled or unspooled, is supported such that the coil axis is vertical, and the coil is stationary during dispensing. A rotating guide is coaxially supported relative to the coil located above the coil upper end and the lower end of the guide is located adjacent the coil periphery such that as wire is pulled through the guide by the welder, the guide will rotate about the coil feeding the wire into the guide and a conduit which leads the wire to the point of use.

A dust impervious cap, usually formed of synthetic plastic overlies the upper end of the coil, or spool, and a flexible curtain depends from the cap circular periphery for location adjacent the coil periphery. In this manner the coil is enclosed and protected at the top and sides from the environment and possible corrosion from foreign matter within the surrounding air. The lower end of the guide extends through the curtain, and a mechanical connection exists between the guide and curtain such that the rotation of the guide also rotates the dust cover.

The dust cover is mounted upon anti-friction bearings supported upon the coil compression ring which is used with unspooled wire, or the dust cover bearings are mounted upon a plate positioned upon the upper spool of a spool of coiled wire.

With spooled wire, a plate is positioned upon the upper surface of the upper spool flange, and this plate includes orientation tabs which cooperate with the dust cover bearing to locate the dust cover relative to the spool and insure consistent and proper operation of the wire guide during dispensing.

With unspooled wire, a base is provided as formed by three-shaped elements intersecting at a common location coincident with the coil axis. The guide support coaxially located within the coil utilizes a quick connector at its lower end for association with the base members and this quick connector is a modified bayonet-type connection wherein a radial tang formed on the lower end of the guide support is received within a slotted socket on the base and partial rotation of the support locks the support to the socket and base.

The compression ring used with unspooled coils is preferably of a slight conical configuration converging in an upper direction. Thus, when the central region of the compression ring is forced downwardly by the nut mounted upon the guide support, the central region of the compression ring is deformed, and as the coil is depleted, the removal of the wire at the coil periphery permits the outer regions of the compression ring to automatically deform toward the coil to improve retention of the wire on the coil as it is used.

Also disclosed in the invention is a moisture impervious base upon which an unspooled coil rests, the base protects the lower region of the coil from floor moisture and foreign matter. A metal bracket is used with this synthetic plastic base and the quick connect apparatus for the guide support is located in the metal bracket.

Also forming a part of the instant invention is the use of a quick connect coupling at the outlet end of the wire guide and the inlet end of the wire conduit. This coupling is of a standard type utilizing ball detents, and permits ready rotation between the guide and the conduit, yet permits these components to be readily separated and reattached during coil replacement.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
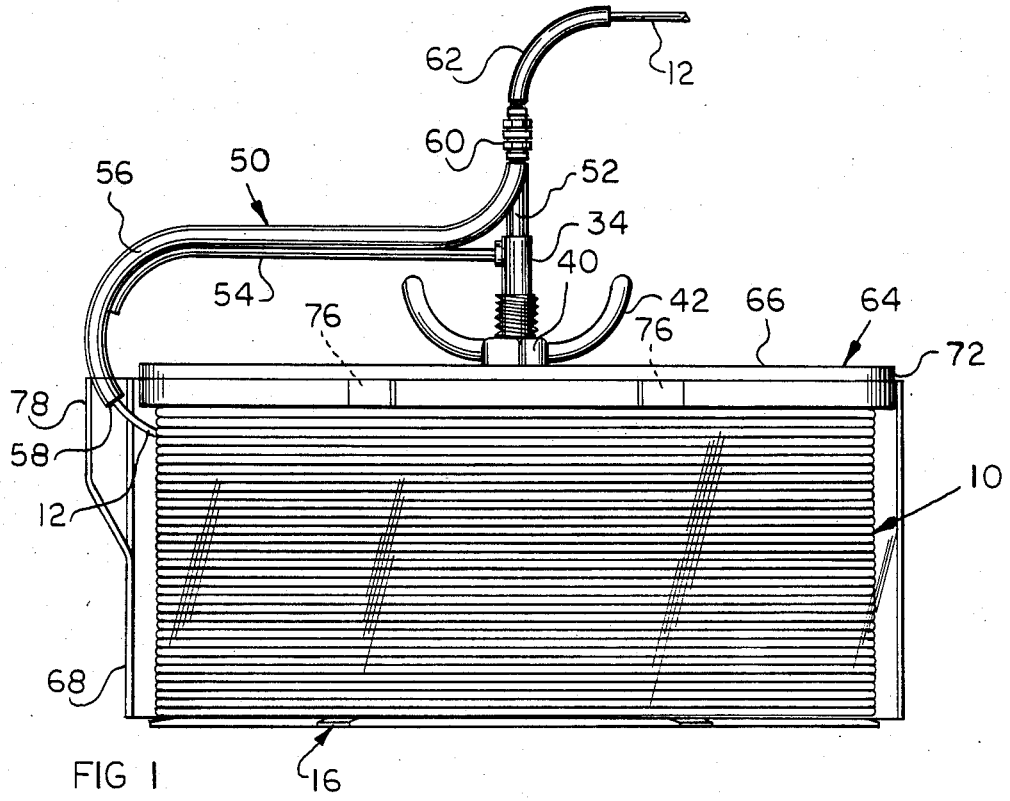
FIG. 1 is a side elevational view of a wire dispenser in accord with the invention as used with an unspooled wire coil.
Figure 2:
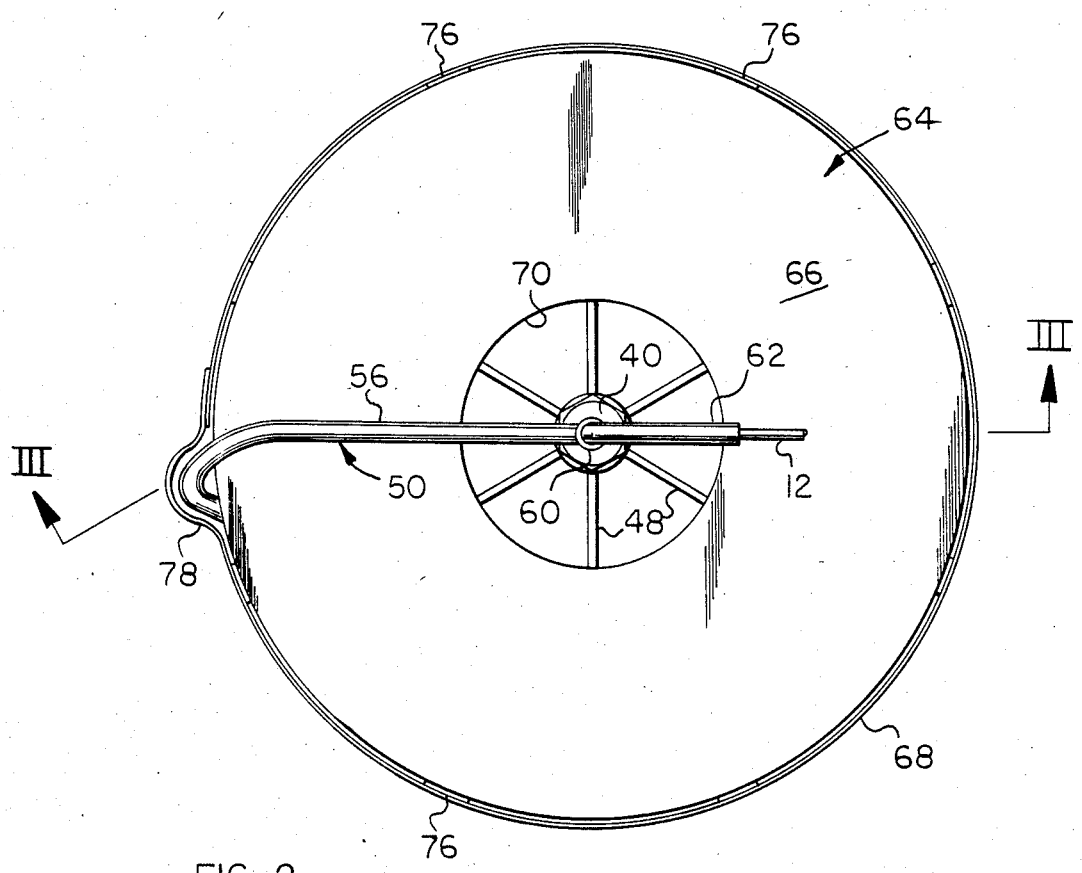
FIG. 2 is a top, plan view of the dispenser of FIG. 1.
Figure 3:
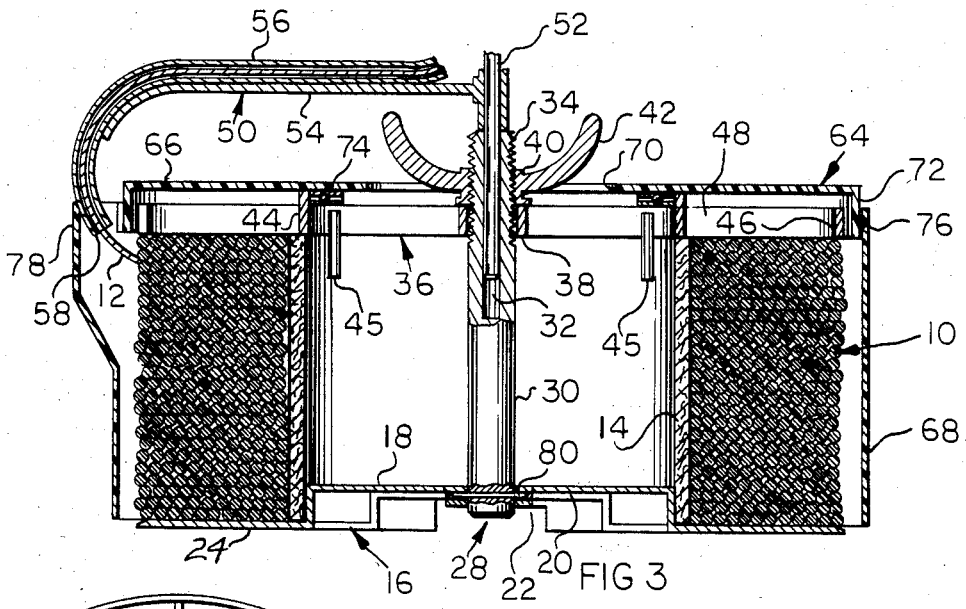
FIG. 3 is an elevational, sectional view of the dispenser of FIG. 2 as taken along Section III—III thereof.
Figure 10:
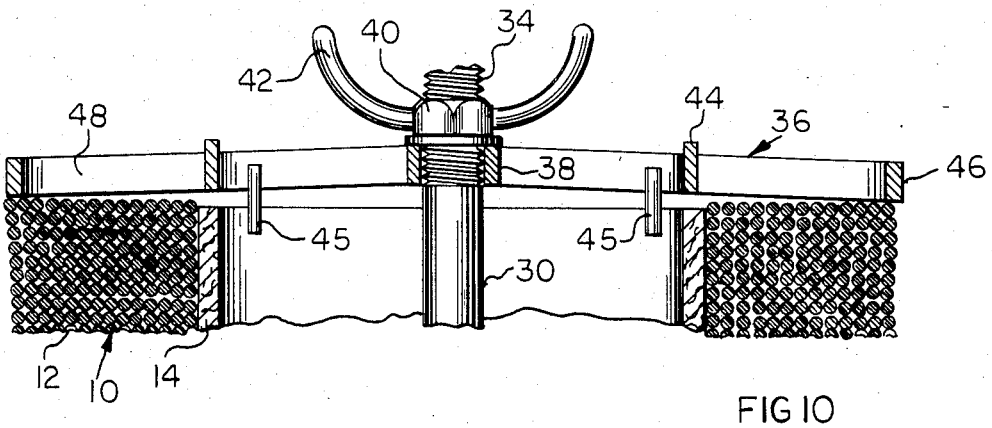
FIG. 10 is an enlarged, partial, elevational, sectional view illustrating the upper region of an unspooled coil showing the compression ring prior to compression, and disclosing the conical configuration of the ring.

With reference to FIGS. 1–3, an unspooled coil of welding wire is generally represented at 10. The coiled wire 12 is wound upon a tubular hub or core 14 often formed of heavy paper or similar material. The wire 12 is tightly wound upon the core and for shipping purposes bands, not shown, extend about the wire and through the core to confine the wire on the core. Once the coil is compressed upon the dispenser, the shipping bands are removed. Usually, the axial length of the wound wire coil will be slightly greater than the length of the core, as will be appreciated from FIG. 10 wherein a "new" coil is shown as initially engaged by the dispenser compression ring.

Figure 5:
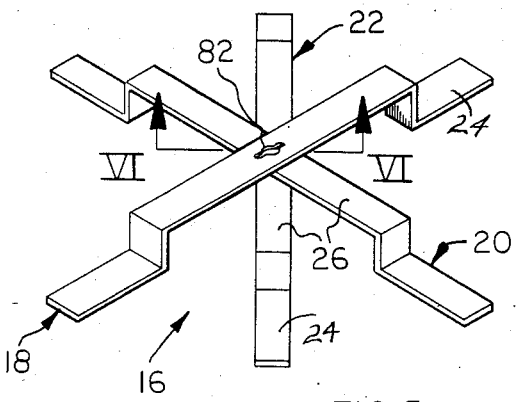
FIG. 5 is a perspective view of the coil base as used with the embodiment shown in FIGS. 1–3.
Figure 6:
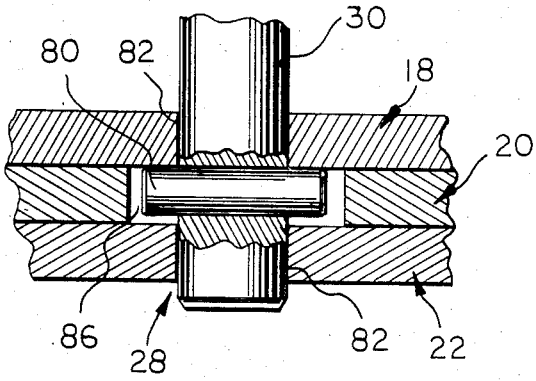
FIG. 6 is an enlarged, detail, diametrical, sectional view of the quick release connection between the coil base structure and the guide support.
Figure 7:
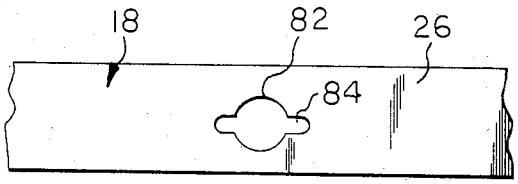
FIG. 7 is a partial, plan view of the central region of the upper base element.
Figure 8:
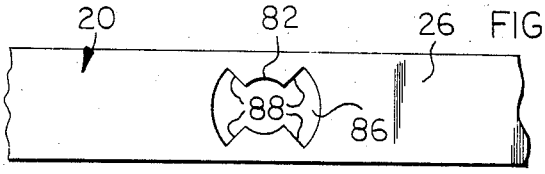
FIG. 8 is a partial plan view of the central region of the intermediate base element.
Figure 9:
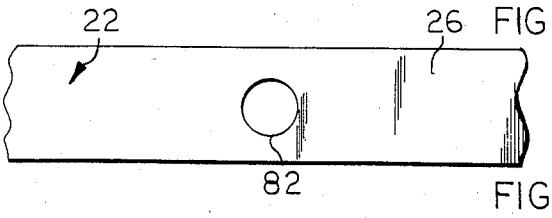
FIG. 9 is a partial plan view of the central region of the lower base element.

The coil 10 of welding wire is placed upon a base 16 such as shown in FIG. 5 wherein the axis of the coil will be vertically oriented and the lower end of the coil will be engaging the base while the upper coil end will be confined by a compression ring, as later described.

The base 16, as illustrated in FIG. 5, consists of three generally similar elements 18, 20 and 22, each including a lower portion 24 which extends under the coil lower end, and central regions 26 extend upwardly such that the three elements may engage and cross at a common central location and are oriented at 60° relative to each other. The elements 18–22 are welded together at the center of their central regions and a quick connect coupling generally indicated at 28, is located at this location. The diametrical dimension of the upstanding central regions 26 is such as to be received within the coil core 14 as apparent in FIG. 3 and in this manner the coil 10 is centrally located upon the base elements.

Figure 4:
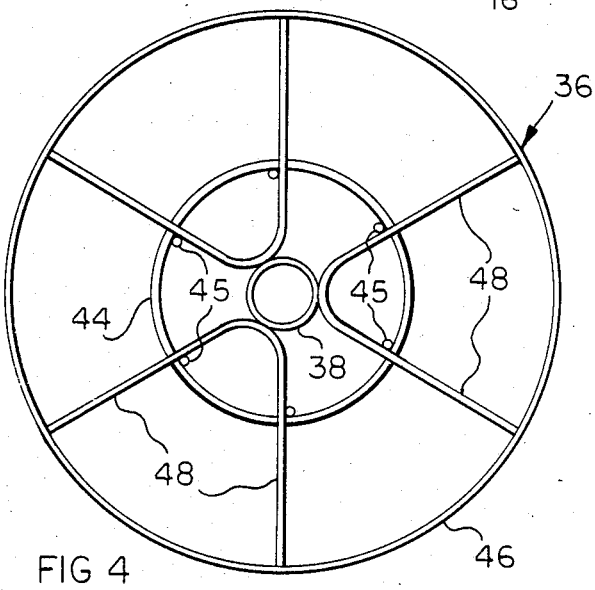
FIG. 4 is a top, plan view of the compression ring, per se.

A wire dispenser guide support 30 consists of a vertically oriented post connected at its lower end to the coupling 28 at the center of the base 16, and provided at its upper end with a bore 32 and external threads 34. The compression ring 36, FIG. 4, includes a central hub ring 38 through which the support 30 extends and the compression ring is tightened upon the coil upper end by the nut 40 engaging threads 34 and including handles 42. The compression ring 36 includes an upper cover bearing orientation ring 44, downward extending core orientation pins 45, and an outer peripheral ring 46 interconnected to the hub 38 by radial spokes 48. The orientation ring 44 is defined by a plurality of segments welded between the spokes 48 and the ring segments extend slightly above the upper edge of the spokes so as to receive the cover bearing therebetween, as later described. The ring is fabricated by welding bar stock and in its normal configuration is of a slightly conical form as appreciated from FIG. 10.

The nut 40 is tightened upon the compression ring 36 to deform the central region of the compression ring downwardly against its conical configuration until the spokes 48 firmly engage the top edge of the core 14. At this time the outer region of the compression ring will engage the upper coils of the coiled wire, and completion of the tightening of the nut will firmly retain the wire coil 10 between the base 16 and the compression ring 36.

Figure 11:
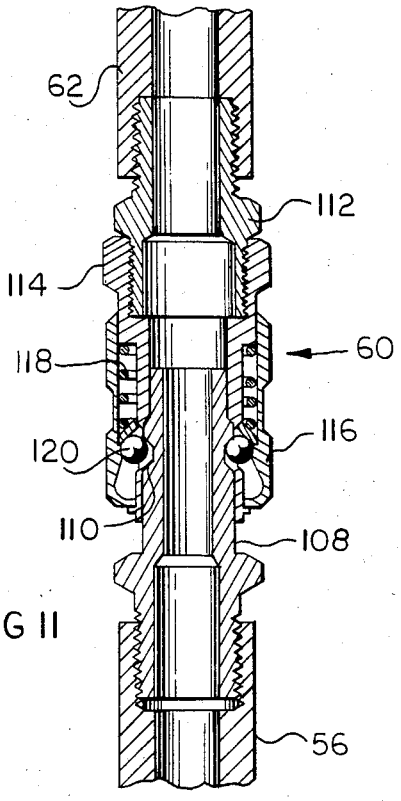
FIG. 11 is a sectional, diametrical, elevational, sectional view of the quick connect coupling used at the outlet of the wire guide and the inlet of the wire conduit, the components of the coupling being shown in the fully connected condition.

The wire dispensing guide generally indicated at 50 is rotatably mounted upon the support 30 by the shaft 52 received within the bore 32. Brace 54 affixed to the shaft supports the tube 56 which is shaped to locate the tube inlet end 58 adjacent the periphery of the coil 10, and as will be appreciated from FIGS. 1 and 3, the inlet end of the guide extends below the compression ring 36. The upper end of the tube 56 is concentrically located with respect to the shaft 52 and the male portion of the quick connect coupling 60 shown in FIG. 11 is attached thereto. The female portion of the quick connect coupling 60 is attached to the lower or inlet end of the wire transfer conduit 62 as shown in FIG. 1. The conduit 62 is usually flexible, and extends to the welder or point of use of the wire 12.

The dust cover 64 which encloses the wire coil 10 consists of a horizontally disposed cap 66 from which depends the flexible curtain 68. As will be appreciated from the drawings, the cap 66 is of a circular configuration having a central opening 70 to provide clearance for the nut handles 42 and includes a downwardly extending circumferential periphery as defined by flange 72. Preferably the cap 66 is formed of synthetic plastic material. On its underside, the cap is provided with an annular anti-friction bearing 74 of the type commonly referred to as "lazy susan" bearing. The bearing 74 rests upon the compression ring spokes 48 between ring 44, and orientation ring 44 will maintain the cap 66 concentric to the compression ring 36 and coil 10.

The curtain 68 is preferably formed of a flexible synthetic plastic transparent material wherein the coiled wire may be readily observed therethrough. The curtain 68 is removably attached to the cap flange 72 by a plurality of fasteners 76, which may take the form of looped and hook patches commonly available under the trademark Velcro, or more conventional snap fasteners may be used. The curtain 68 extends throughout the circumference of the cap and extends downwardly along the coil periphery to the extent readily appreciated from FIGS. 1 and 3.

The curtain 68 is of such circumferential length that a "loop" 78 may exist wherein the lower end of the guide tube 56 extends therethrough, and the location of the guide tube within the loop 78 constitutes a mechanical connection between the wire dispensing guide 50 and the dust cover 64. Thus, as the guide 50 rotates as the wire 12 is pulled therethrough, the guide will engage the cover loop and rotate the cover 64 at the same rate as the guide during wire dispensing. The "drag" of the dust cover 64 eliminates the need for a friction brake of the type as shown in U.S. Pat. No. 4,253,624, and the dust cover will move intermittently about the axis of the coil 10 with the intermittent movement of the dispenser.

As the wire 12 is removed from the coil 10 the degree of compression resistance of the coiled wire against the outer regions of the compression ring 36 will lessen, and as this occurs, the deformation that has resulted in the metal compression ring during the initial tightening of nut 40 will cause the periphery of the compression ring, due to the natural resiliency of the ring metal, to be biased downwardly toward the coiled wire and improve the retention of the coiled wire without requiring retightening of the nut 40.

The quick connect coupling 28 between the base 16 and the guide support 30 is best shown in FIGS. 6–9. The lower end of the support 30, which is cylindrical, includes a diametrical extending tang or pin 80, FIG. 6, which radially extends beyond the configuration of the support. The central regions of the base elements 18, 20 and 22 are each provided with a circular bore 82 only slightly larger in diameter than that of the support 30, and these bores are coaxially aligned as will be appreciated from FIG. 6. The element 18 includes diametrical slots 84 formed therein for receiving the tang 80. Thus, the tang 80 may be received within the shaped cavity 86 formed in element 20, and such positioning of the tang will locate the lowermost portion of the support 30 within the bore 82 of base element 22.

The cavity 86 is provided with stop shoulders 88 which will engage the tang 80 after partial rotation has occurred between the support member 30 and the base 16. Thus, the tang 80 is inserted through the element 18 and support 30 is rotated about 45° so as to misalign the slots 84 with the tang 80 until the tang engages the stops 88. This misalignment will axially lock tang 80 within cavity 86 and axially lock the support member 30 relative to the base 16 and permit the nut 40 to effectively tighten the compression ring 36 upon the coil 10. The fact that the support member 30 is received within the bores 82 assures that the support member will be accurately located within the coil, and this type of quick connection between the base and guide support is not as likely to be damaged by careless handling as if the support member were threaded into the base.

Figure 13:
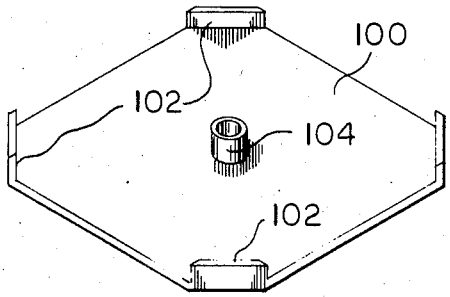
FIG. 13 is a perspective view of the dust cover bearing orientation plate as used with a spooled wire coil.
Figure 14:
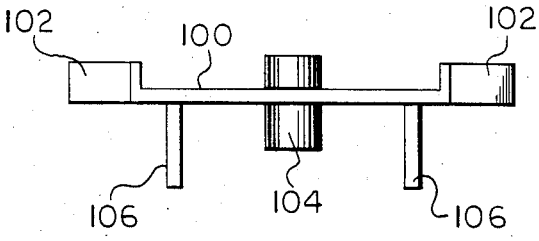
FIG. 14 is an elevational side view of the bearing orientation plate of FIG. 13.
Figure 12:
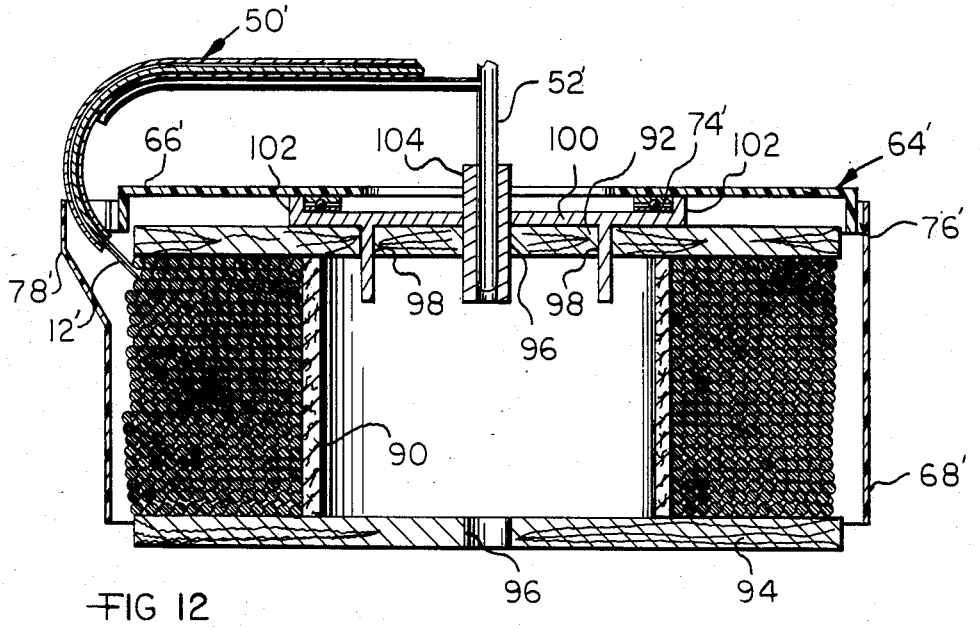
FIG. 12 is a diametrical, elevational, sectional view of a spooled coil of welding wire utilizing a dust cover in accord with the inventive concepts.

The inventive concepts of the dust cover 64 may also be used with welding wire which is spooled, as shown in FIGS. 12–14. In FIG. 12 a typical spool of welding wire is shown and components previously described indicated by primed reference numerals. The coiled wire 12' is wound upon the cylindrical core 90 located between radial flanges 92 and 94. The flanges are usually formed of wood, or wood composition, but may be made of synthetic plastic steel or aluminum, and are provided with central holes 96.

To use a dust cover 64' in accord with the invention with spooled wire a pair of holes 98 are drilled in the upper spool flange 92 on opposite sides of the central hole 96 for receiving the dust cover bearing guide plate generally indicated at 100. The plate 100, as illustrated, is of a generally square configuration having an upper surface and each corner of the plate is bent upwardly to define a projection 102. Centrally, the plate 100 is provided with a tubular bushing 104, and from its lower surface a pair of pins 106 extend downwardly. The plate 100 is placed upon the spool upper flange 92 with the pins 106 extending through the holes 98, and the bushing 104 received within hole 96 and the wire guide shaft 52' is rotatably received within the bushing 104 in a manner similar to that shown in FIG. 3.

The dust cover components are identical to those previously described. The cap 66' extends over the spool flange 92 and the anti-friction bearing 74' rests upon the plate 100 between the projections 102. The projections 102 will centrally maintain the cap on the spool flange and the curtain 68' will protect the coil periphery from environmental contamination. As the guide 50' rotates about the spool as wire 12' is used, the guide will rotate the dust cover components in a manner identical to that of the embodiment of FIGS. 1–3. As with the previously described embodiment, fasteners 76' affix the upper end of the curtain to the cap flange 72' in a removable manner, and as the plate 100 is not a permanent part of the spool, the disclosed apparatus discloses an economical manner for dispensing welded wire from a spooled coil while maintaining the wire free from foreign matter and corrosive environmental influence.

FIG. 11 illustrates in detail a typical quick connect coupling 60 as used to interconnect the upper outlet end of the guide tube 56 to the inlet end of the conduit 62. The coupling shown in FIG. 11 is of a standard quick disconnect type as used with air hoses, air tools and the like. The male member 108 is affixed to the upper end of the guide tube 56 by threads and includes an outer cylindrical surface having an annular recess 110 formed thereon. The female member 112 threads into the lower end of the conduit 62 and includes a body 114 having a locking sleeve 116 axially displaceable thereon against the influence of the spring 118. A plurality of ball detents 120 are located within the female member body 114 in the known manner, and cam surfaces formed on the sleeve 116 permit the balls to be radially forced inwardly, as shown in FIG. 11, into recess 110, or permit the ball detents to move radially outwardly when the sleeve is retracted. At such time the female member 112 may be readily removed from the male member 108. This type of quick connect coupling permits the male and female members to rotate relative to each other and the concentricity between the coupling parts will be maintained during operation. When welding wire coils are replaced, the coupling 60 may be quickly operated to release the conduit 62 from the guide 50, and after the dispensing structure has been mounted upon a new coil, the wire 12 may be easily fed into the conduit 62 through the coupling 60 and the coupling male and female members reconnected.

Figure 16:
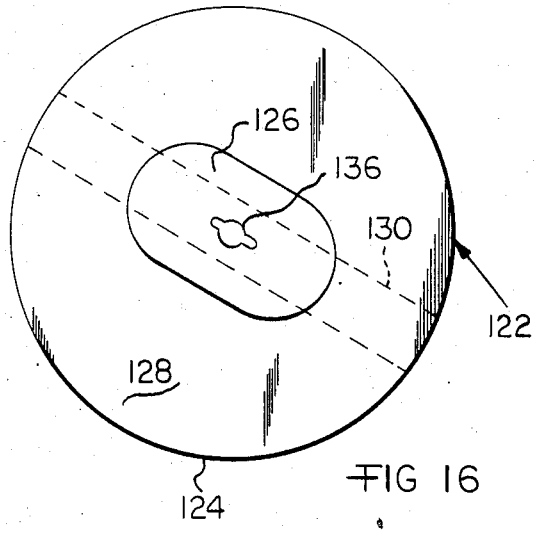
FIG. 16 is a plan view of the base of FIG. 15.
Figure 15:
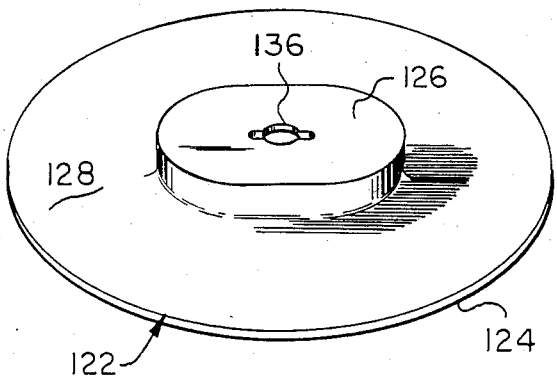
FIG. 15 is a perspective view of a variation of base as used with an unsoooled wire coil.
Figure 17:
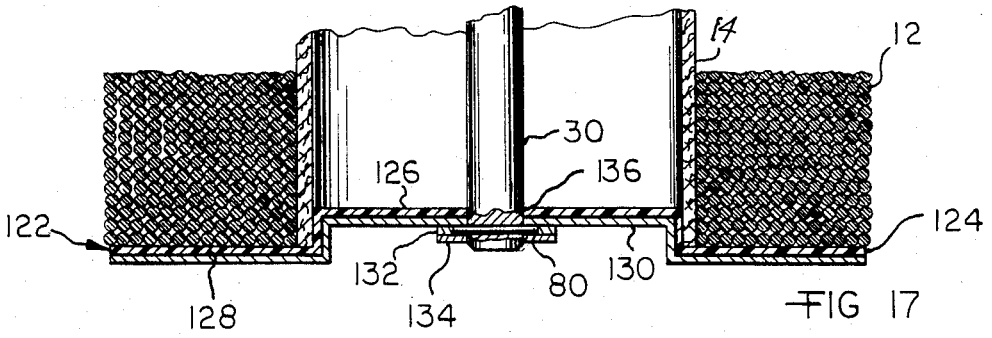
FIG. 17 is an elevational, partial, sectional view of the base of FIGS. 15 and 16 as used with an unspooled wire coil.

FIGS. 15–17 illustrate another embodiment of a base which may be used with a coil 10 of unspooled wire. This base 122 is formed of synthetic plastic sheet material of relatively heavy gauge, approximately ¼" thick, which is impervious to moisture, and the base protects the lower end of the coil from moisture within the floor or the surface upon which the coil rests.

The base 122 is of a generally circular configuration having a circular periphery 124 substantially equal to the diameter of the coil 10, FIG. 17. The central region 126 of the base extends upwardly, and is of an oblong configuration whose maximum dimension is slightly less than the inner diameter of the spool core 14. The base portion 128 is planar, and extends under the core and coiled wire, and the weight of the wire coil firmly holds the base 122 in position.

A metal bracket 130 is located below the plastic base 122 as apparent in FIGS. 16 and 17 and is of a configuration conforming to the underside of the base, and the oblong shape of region 126 prevents rotation of the bracket relative to the base. At its central region, the metal bracket 130 is provided with plates 132 and 134 in which bores and openings are provided identical to the quick connect coupling 28 shown in FIGS. 6–9 to which the guide support 30 is affixed. It will be appreciated from FIGS. 15 and 16 that an opening 136 is defined in the central region for receiving the support member 30 and the tang 80, and the support member 30 is inserted through the opening 136 and into the bracket 130 for connecting the guide support to the base of this embodiment.

From the above description it will be appreciated that the inventnion provides an improved dispenser for welding wire and other coiled strands, either spooled or unspooled. The coiled wire is effectively protected from the environment by the dust cover 64, and the improvements in the attachment of the wire guide support to the base, the compression ring, and the interconnection between the wire guide and wire conduit all result in a dispenser which is easier to use, dependable in operation, and capable of maintaining the wire in a clean and usable condition. While the invention has been described in the context of and as primarily suitable as a welding wire dispenser, it is to be understood that the invention may be used to dispense any metal or nonmetal strand wound in a coil or on a spool, including yarn or cord, and use of the term "welding wire" in the specification and claims is not to be considered limiting.

It is appreciated that various modifications to the inventive concepts may be apparent to those skilled in the art without departing from the spirit and scope of the invention.

I claim:

1. In an elongated strand dispenser wherein a strand coil includes an axis and a periphery and is supported such that the coil axis is substantially vertically oriented wherein the coil includes upper and lower ends, a strand guide rotatably extending from the coil upper end having a strand inlet disposed adjacent the coil periphery and adapted to rotate about the coil periphery to remove a strand therefrom, the improvement comprising, a dust cover disposed about the strand coil, means rotatably supporting said dust cover for rotation relative to the strand coil about a substantially vertical axis, and means interconnecting the strand guide to said dust cover whereby rotation of the guide rotates said cover about its axis.

2. In a strand dispenser as in claim 1, said dust cover including a first portion extending over the coil upper end and a second portion located adjacent the coil periphery.

3. In a strand dispenser as in claim 2, said cover first portion being substantially horizontally disposed across the coil upper end, and said cover second portion being substantially vertically disposed and enclosing the coil periphery.

4. In a strand dispenser as in claim 3, said cover first portion comprising a cap having a circular periphery, and said cover second portion depending from said cap periphery.

5. In a strand dispenser as in claim 4, said cover second portion comprising a flexible curtain.

6. In a strand dispenser as in claim 5, said flexible curtain being transparent.

7. In a strand dispenser as in claim 4, cooperating releasable fastening means mounted upon said cap periphery and said cover second portion whereby said cover second portion is releasably connected to said cap periphery.

8. In a strand dispenser as in claim 1, said means rotatably supporting said dust cover comprising a bearing having an axis substantially coincident with the coil axis.

9. In a strand dispenser as in claim 8, said bearing comprising an anti-friction bearing having rotatable elements.

10. In a strand dispenser as in claim 8, a coil compression ring engaging the coil upper end, means compressing said ring upon the coil upper end, and bearing orientation means defined upon said ring cooperating with said cover bearing to locate said cover with respect to said ring and coil, said cover extending over said ring.

11. In a strand dispenser as in claim 8, a spool having a core and upper and lower flanges, the strand coil being located upon said spool between said flanges, said upper flange having an upper surface and a vertical axis, and removable bearing orientation means mounted on said upper flange upper surface concentric to said upper flange axis cooperating with said cover bearing to locate said cover with respect to said upper flange and coil, said cover extending over said spool upper flange.

12. In a strand dispenser as in claim 11, said bearing orientation means comprising a plate having upper and lower surfaces, upwardly extending first projections defined on said plate extending from said plate upper surface, said cover bearing being received between said first projections, downwardly extending second projections defined on said plate extending from said plate lower surface, recesses defined in said upper flange upper surface, said second projections being received within said recesses locating said plate upon said upper flange.

13. In an elongated strand dispenser for a strand coil comprising an elongated strand coiled upon a cylindrical core having a substantially vertical axis and upper and lower circular ends, an elongated strand guide support coaxially located within the core extending above the core upper end, a rotatable strand guide mounted upon the guide support, a resiliently deformable coil compression ring superimposed over the coil and core upper end having a central region, upper and lower sides, and a peripheral region, the guide support extending through the ring central region, ring compression means defined on the guide support engaging the ring upper side at the central region for forcing the ring toward the core and coil, the improvement comprising, the compression ring having a normal non-planar slightly conical configuration whereby the lower side of the peripheral region extends below the lower side of the central region such that the ring peripheral region lower side engages the strand coiled on the core prior to the ring central region lower side engaging the core upper end and upon the ring compression means deforming the ring central region lower side into engagement with the core upper end the resultant ring deformation produces a biased compression force on the coiled strand at the ring peripheral region to aid in confining the coiled strand as the coil is depleted.

14. In a welding wire dispenser wherein a coil of welding wire includes an axis and a periphery and is supported such that the axis is substantially vertically oriented wherein the coil includes upper and lower ends, a wire guide rotatably extending from the coil upper end having a wire inlet disposed adjacent the coil periphery and adapted to rotate about the coil periphery to remove a wire strand therefrom, a coil base disposed under the coil lower end supporting the coil, an elongated wire guide support mounted upon the base coaxially extending upwardly through the coil and having an upper end extending above the coil upper end and a lower end connected to the coil base, a coil compression ring engaging the coil upper end, ring compression means mounted upon the guide support upper end adjustably positionable thereon in a vertical direction and engagable with the compression ring, the wire guide being rotatably mounted on the guide support upper end, the improvement comprising, quick release connector means defined upon the coil base and the guide support having cooperating abutments whereby partial rotation of the guide support about its length aligns said abutments in engaging relationship and restrains the guide support against axial movement relative to the coil base.

15. In a welding wire dispenser as in claim 14, said quick release connector means comprising a socket defined in the coil base, said socket having a longitudinal axis and upper, central and lower regions, first abutment means defined in said socket, an elongated projection having an axis defined on the wire guide support lower end closely receivable within said socket, and second abutment means defined on said projection radially extending therefrom selectively engaging said first abutment means upon relative partial rotation of said projection about its axis within said socket.

16. In a welding wire dispenser as in claim 15, said socket upper and lower regions comprising cylindrical bores, a radial slot defined in said upper region intersecting said upper region bore and said socket central region, said central region having a radial dimension greater than that of said upper region, said projection being cylindrical and closely rotatably received within said bores of said socket upper and lower regions, a radially extending tang defined on said projection receivable in said slot whereby said tang may be received within said socket central region, said tang having a radial dimension greater than that of said socket upper region bore, and a stop surface defined within said socket central region engaging said tang upon rotation of said projection to vertically misalign said tang and slot.

17. In a welding wire dispenser as in claim 14, the coil base comprising a substantially circular member having a central region, a periphery, and a planar mositure imprevious coil engaging region radially intermediate said central region and said periphery engaging the coil lower end, said base central region extending upwardly from said coil engaging region having a maximum diametrical dimension slightly less than the inner diameter of the coil and received therein.

18. In a welding wire dispenser as in claim 17, said circular member being formed of synthetic plastic material, a metal bracket located below said base central region, said quick release connector means being defined in said metal bracket.

* * * * *